US009196233B2

(12) United States Patent
Schulze

(10) Patent No.: US 9,196,233 B2
(45) Date of Patent: Nov. 24, 2015

(54) PROTECTIVE PAD OR COVER DEVICE FOR A MUSICAL INSTRUMENT

(71) Applicant: Robert T. Schulze, Lanhorne, PA (US)

(72) Inventor: Robert T. Schulze, Lanhorne, PA (US)

( * ) Notice: Subject to any disclaimer, the term of this patent is extended or adjusted under 35 U.S.C. 154(b) by 0 days.

(21) Appl. No.: 14/056,159

(22) Filed: Oct. 17, 2013

(65) Prior Publication Data

US 2014/0109749 A1 Apr. 24, 2014

Related U.S. Application Data

(60) Provisional application No. 61/715,942, filed on Oct. 19, 2012.

(51) Int. Cl.
*G10D 3/18* (2006.01)

(52) U.S. Cl.
CPC ..... *G10D 3/18* (2013.01)

(58) Field of Classification Search
CPC ..... G10D 3/02; G10D 1/08; G10D 1/085; G10D 1/005; G10D 3/06; G10D 3/00; G10D 1/00; G10D 3/04; G10D 3/12; G10D 1/10; G10D 17/00; G10D 1/02; G10D 1/04; G10D 3/003; G10D 3/08; G10D 3/14; G10D 3/143; G10D 3/16
USPC ..... 84/290, 267, 291, 327, 329
See application file for complete search history.

(56) References Cited

U.S. PATENT DOCUMENTS

| | | | | |
|---|---|---|---|---|
| D302,435 | S | 7/1989 | Pearse | |
| 4,966,062 | A * | 10/1990 | Driggers et al. | 84/327 |
| 6,054,642 | A * | 4/2000 | Brooks | 84/267 |
| 2005/0257664 | A1 * | 11/2005 | Kessler | 84/453 |

OTHER PUBLICATIONS

Terance Tan, Guitar Bench Magazine, Guitar Armrests Part1:After Market Rests, Jul. 17, 2008.
Terance Tan, Guitar Bench Magazine, Rasguero Arm Rests, Oct. 9, 2008.
Andreas Abel Armrests Advertisement—Web Page.
Classical Guitar Plus Web Page, Liikanen Brand Classical Guitar Armrest-Mukava-Web page picture of armrest dated Feb. 3, 2012.

* cited by examiner

*Primary Examiner* — Kimberly Lockett

(57) ABSTRACT

A removable cover or protective device has been developed for the lower bout area of a guitar or like musical instrument, especially a classical or acoustic guitar, where the arm meets the instrument in a normal performing position. The device protects the instrument surface from perspiration and also can alleviate potential nerve damage created by resting the forearm on the edge of the instrument. In a typical form, the protective covering can be comprised of leather, faux leather, or leather like polymer, and can be secured to the instrument by the optional use of suction cups attached to the topside of the lower bout of the instrument in a removable manner.

11 Claims, 4 Drawing Sheets

APPLICATION VIEW

ISOMETRIC VIEW

APPLICATION VIEW

ISOMETRIC VIEW

FRONT VIEW

BOTTOM VIEW

SIDE VIEW

TOP VIEW

ONE EMBODIMENT SIDE VIEW

ONE EMBODIMENT TOP VIEW

PROTECTIVE PAD OR COVER DEVICE FOR A MUSICAL INSTRUMENT

CROSS-REFERENCE TO RELATED APPLICATIONS

This application claims the benefit of provisional patent application Ser. No. 61/715,942, filed 2012 Oct. 19 by the present inventor.

FEDERALLY SPONSORED RESEARCH

None

SEQUENCE LISTING

None

BACKGROUND OF THE INVENTION

1. Field

The present disclosed subject matter is in the field of protective covers for musical instruments, and more specifically guitars.

Quality guitars are expensive instruments. In addition to being highly prized possessions of serious musicians, they can become collector items of great value. Musicians and collectors accordingly take great pains to care for and preserve the finishes of their guitars, which often consist of expensive or exotic woods. However, guitars are ultimately meant to be used, and their use subjects them to wear. A common area of wear is the soundboard at the upper portion of the lower bout where the forearm rests on the guitar in a normal playing position. This wear is most evident when an instrumentalist plays sleeveless in which sweat and oils from the arm come in contact with the various parts of the instrument.

2. Prior Art

In the art, there are a number of guitar protecting devices, however they all have their limitations and serious shortcomings. There is a need for an improved, cost effective and functional protecting device. A common device for protecting a guitar's surface is an elasticized cloth "sock" which fits over the arm of the player. The sock is unattractive, unpleasant to wear, and musicians are generally unwilling to use it during a performance because of its appearance. One form of protection involves a strip of wood permanently glued to the edge of the instrument, which many musicians, collectors and retail dealers are unwilling to use, due to its permanency, and potential damage to the instrument. Another form of instrument protection is a device that through a series of suction cups attaches a wood or plastic edge to the instrument.

Some guitar makers, like Greg Smallman®, propose an armrest integrated to the guitar. An armrest provides three primary benefits: it reduces damping of the top of the guitar caused by the right forearm; it is potentially more comfortable for the player; and it absorbs the wear to the finish that would otherwise happen on the top, the binding, and the side. These benefits are of particular importance for ultra-thin-topped instruments, such as Smallman's, but can subtly improve any guitar, including double-tops. However, the Smallman® armrests are built into the Smallman® guitars. This would require modification to other brand and type guitars and would require gouging out the wood in the guitar to accommodate the armrest. This is a permanent solution that enhances Smallman guitars but will detrimentally effect the value in other guitars that have one installed. Many professional and serious guitar owners would be hesitant to take this permanent step. In addition, Smallman® armrests will not provide sweat absorption from a sleeveless performer.

The Rasgueo-Rest® armrest helps large and tall players avoid hunching-over the guitar, since the guitar's surface area is in effect, "expanded" using the arm-rest, giving the arm-height support needed for good playing posture. Its main value is targeted specifically for taller people and their posture. The Rasgueo-Rest® armrest is made of hard plastic and won't fit in most instrument cases without removal; it requires suction cups to use and doesn't provide soundboard protection from a variety of playing styles. In addition, the Rasgueo-Rest® armrest will not provide sweat absorption from a sleeveless performer.

The Cumberland® acoustic armrest for guitar doesn't provide soundboard protection from a variety of playing styles. The armrest attaches to the guitar with the use of metal clamps, which can be worrisome at best. It does not provide as much comfort to the forearm and it lays on the soundboard and therefore can dampen the sound. In addition, the Cumberland® acoustic armrest will not provide sweat absorption from a sleeveless performer.

The Qualey-Traudt® armrest, made in Germany is constructed of wood and it's large size won't fit in most instrument cases without removal. It always requires attachment to the guitar with suction cups to use and doesn't provide soundboard protection from arm contact using a variety of playing styles. In addition, the Qualey-Traudt® armrest will not provide sweat absorption from a sleeveless performer.

The Liikanen® classical guitar armrest, made in Finland is constructed of wood, will not fit in most instrument cases without removal, and it always requires attachment to the guitar with suction cups to use. In addition, the Liikanen® classical guitar armrest will not provide sweat absorption from a sleeveless performer.

John Pearse® wood armrests are made in the USA, and are made of wood. The armrests require semi-permanent installation using adhesive strips with the risk of damaging the instrument upon removal. In addition, the John Pearse® armrests will not provide sweat absorption from a sleeveless performer.

The Andreas Abel Armrest, made in Germany, is constructed using a plastic mold. Its large size won't fit in most instrument cases without removal and when in use it has to be fastened to the guitar by a clamping mechanism. It is unattractive and doesn't provide soundboard protection from arm contact using a variety of playing styles, particularly with acoustic guitar performers. In addition, the Andreas Abel armrest will not provide sweat absorption from a sleeveless performer and is not customizable to match a wide variety of instruments and their body shapes.

The Plenesom® armrest, from Brazil, is constructed of ivory wood and it's large size won't fit in most instrument cases without removal. It always has to be attached to the guitar requiring suction cups when it is used. It does not provide soundboard protection from arm contact using a variety of playing styles and is not customizable to match a wide variety of instruments and their body shapes. In addition, the Plenesom® armrest will not provide sweat absorption from a sleeveless performer.

SUMMARY Of INVENTION

The present disclosed subject matter is a protective pad or cover that is positioned over and can be secured to existing portions of a musical instrument, more specifically a classical or acoustic guitar body such that the protective pad covers the top and front surface on the lower bout of the guitar/instrument body to protect it from damage due to arm sweat and oils. In addition, the breathable materials used in construction will provide sweat absorption from a sleeveless performer. Due to its saddle design, the protective pad or cover can be used securely without attachment to the instrument; the use of suction cups is an option. The protective pad or cover also provides padding to alleviate possible nerve damage to the forearm as a result of the hard and sharp 90% angle of the typical guitar/instrument design.

These and other features and advantages of the disclosed subject matter will become apparent upon further reading of this patent application and in light of the accompanying drawings described below.

BRIEF DESCRIPTION OF THE DRAWINGS

FIG. 3 is a frontal view displaying the functional position of the suction cup(s) 4 and 4A as well as demonstrating the stitching 5 method used. The rear view is substantially similar.

REFERENCE NUMERALS

Figure 1:
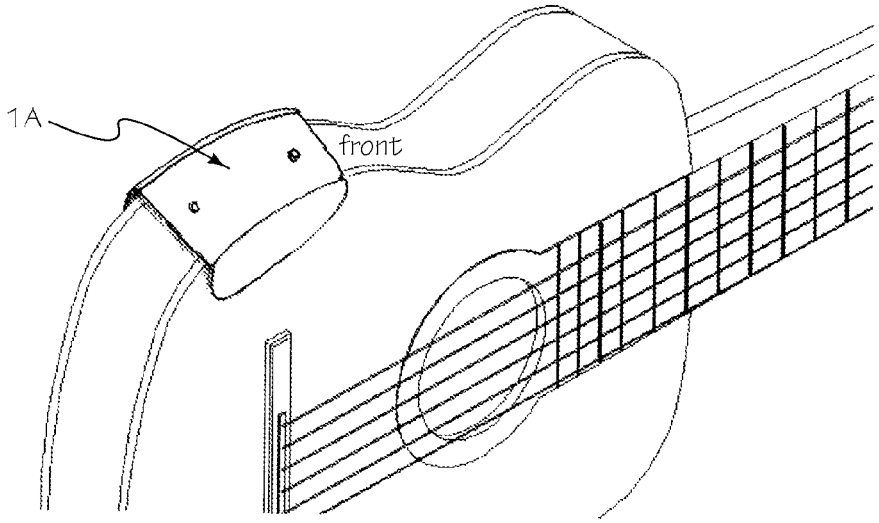
FIG. 1 is an isometric view of the disclosed subject matter in its application to the guitar/instrument.

1A—protective cover device applied on a guitar

1—side pad at sound hole side of guitar/instrument stitched at 5 to top pad 3

2—side pad at back of guitar/instrument stitched at 5 to top pad 3

3—top pad resting on lower bout of guitar/instrument stitched at 5 to pads 1 and 2, containing two holes 6 and slits 6A for optional suction cups 4

4—head of suction cups attached to top pad 3

4A—cup portion of suction cups

5—point of stitching of pad 3 to pads 1 and 2

6—hole with adjacent slit 6A on pad 3

6A—slit with adjacent hole 6

DETAILED DESCRIPTION

A leather or leather like guitar arm rest and cover or protector device can be manufactured and designed to customizable sizes and shapes to cater to a wide spectrum of guitars and related musical instruments. The guitar armrest can be comprised of any material that performs like leather in terms of durability, flexibility, pliability, and sewability, such as leather itself, and leather like polymeric materials such as faux leather. In addition the material should be able to absorb perspiration (permeability to water vapor) and be resistant to mold and mildew. Different embodiments provide the ability to accommodate various playing styles (and arm positions) particularly in the various acoustic guitarist techniques, which would protect areas of the soundboard not provided for by commercial products currently offered. The device herein has a sown in saddle design structure that keeps the shape yet still offers the natural feel and comfort of leather. Also, due to the design and stitching in the leather, the front side of the device is slightly lifted off the guitar so as not to mute the vibrations and lessen the response of the soundboard. Also, extra padding can be added underneath the leather top and connected to and stabilized by the suction cups as an option.

In addition, a saddle design comprised of a leather or leather like material requires no attachment means to the instrument (however, in one embodiment it can use up to two suction cups compared to three in prior art devices such as the Plenosom and Liikanen Armrests) to secure it. This is unlike the prior art armrests which all must use additional attachment means to the instrument. Many users may be uncomfortable with attaching anything to certain finishes such as nitrocellulose lacquer and new instruments that have a soft lacquer and have not entirely cured; new instruments that have a soft lacquer may be susceptible to "imprints" from the suction cups or other means of attachment.

Although the device is customizable to a variety of sizes and shapes of guitars/instruments, the following details provided represent one embodiment for a typical classical guitar and performance position. The following detailed measurements in the Figures are presented to illustrate further various aspects of the present disclosed subject matter, but they are not intended to limit the scope of the disclosed subject matter in any respect.

Figure 2:
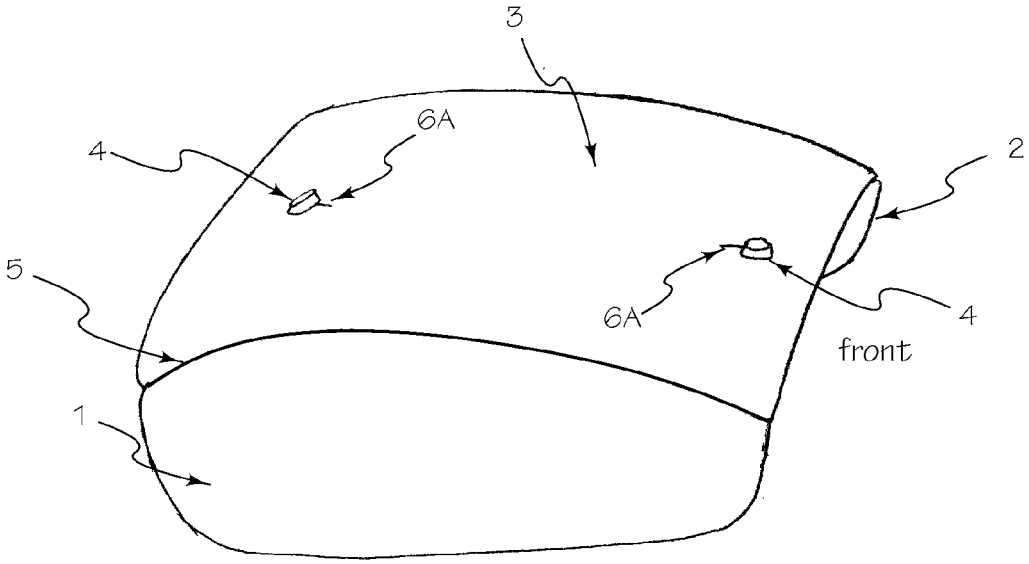
FIG. 2 is an isometric view of the disclosed subject matter with references to its various parts.
Figure 3:
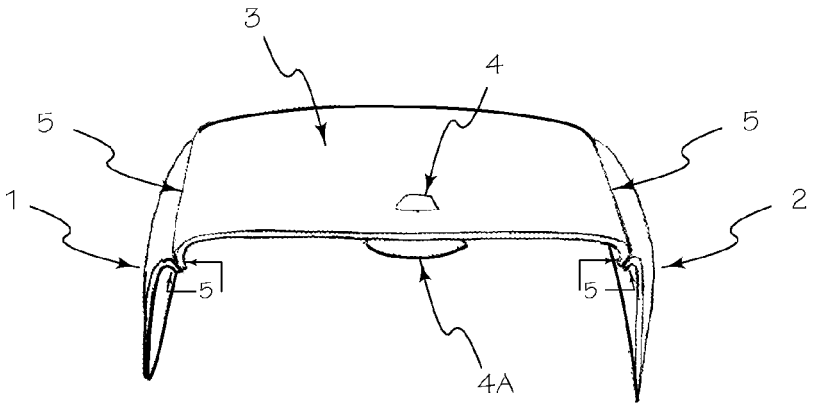
Figure 4:
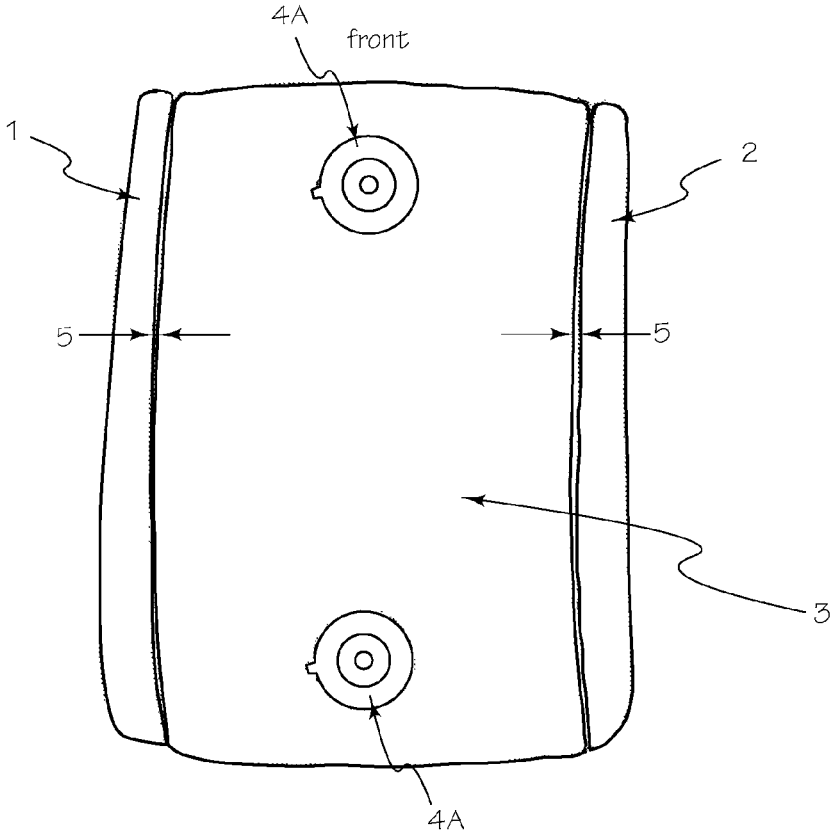
FIG. 4 is a bottom plan view displaying the cup portion 4A of the suction cups.
Figure 5:
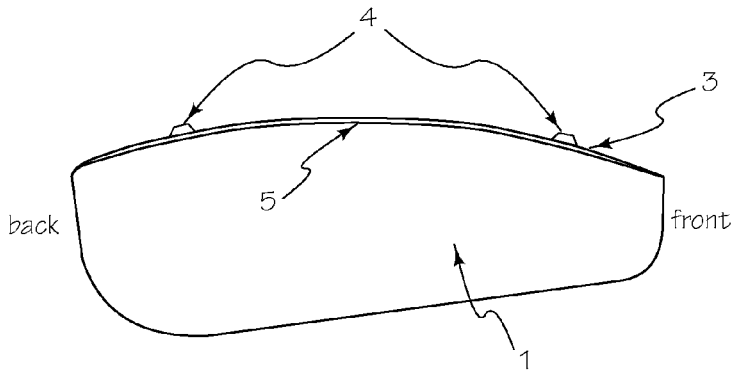
FIG. 5 is a side elevation view thereof; the opposing side view being substantially identical.

As illustrated in FIGS. 1 and 2, the device is applied to the instrument by placing pad 3 on top of the lower bout of a guitar/instrument with pad 1 on the sound hole side and pad 2 on the back side in a saddle type fashion. Suction cups 4A can then be applied to complete the attachment feature of the device should the user prefer to do so.

Figure 7:
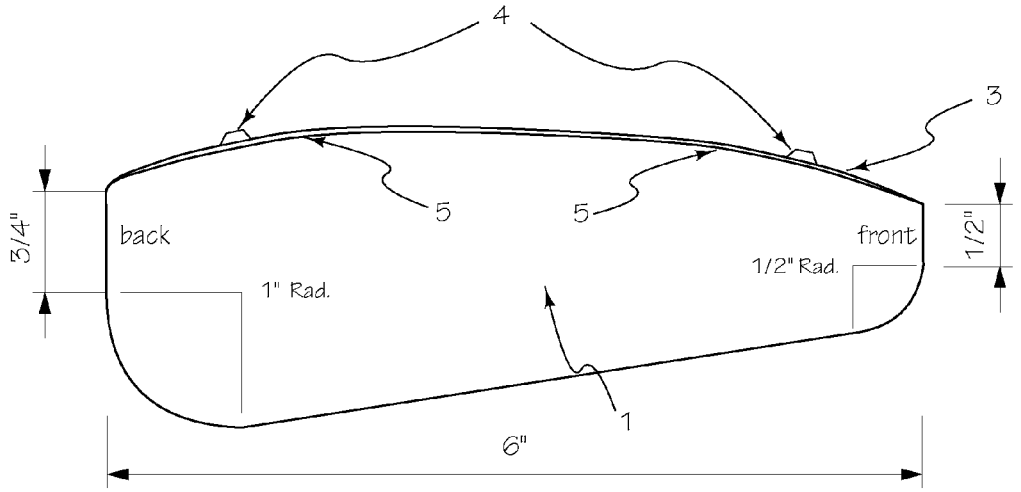
FIG. 7 is a side elevation displaying the dimensions of one embodiment of disclosed subject matter, the opposing side view being substantially identical.

As exemplified in FIG. 7, the top edge of side pads 1 and 2 (2 being mirrored yet identical to 1) are cut using the curve of the lower bout centered at the point of contact where the forearm meets the guitar/instrument body in a typical performance position at a length of around 6 inches. The front edge of pads 1 and 2 are cut using a 0.5 inch line perpendicular from the top edge, with a 0.5 inch radius curve towards the back of the pad, which is measured using a 0.75 inch line perpendicular from the top edge, with a 1.0 inch radius curve towards the front as exemplified in FIG. 7. Typical ranges are a 0.25-1.0 inch cut for the front edge of pads 1 and 2, with a 0.0-1.0 inch radius curve towards the back of the pad, and a 0.25-2.0 inch line perpendicular from the top edge with a 0.0-2.0 inch radius curve towards the front.

Figure 8:
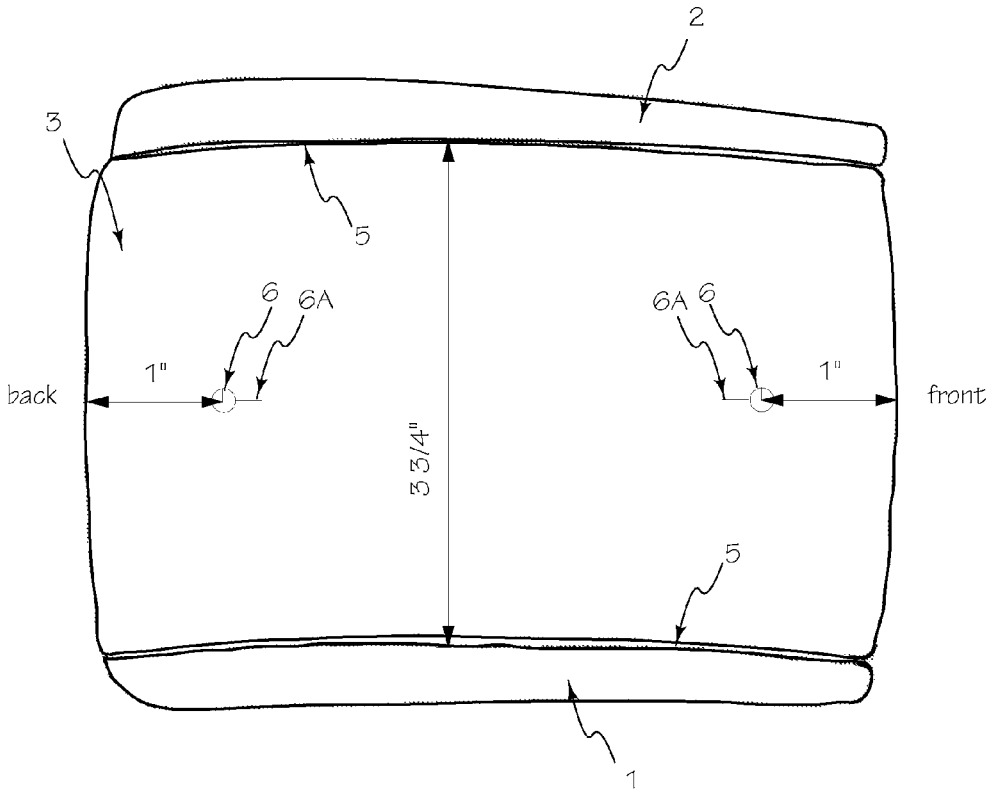
FIG. 8 is a top elevation displaying the dimensions of one embodiment of the disclosed subject matter, showing the design for holes for the optional suction cups.

Exemplified in FIG. 8, the top pad 3 is cut based on the width of a typical guitar body of 3.75 inches. An extra 0.4-inch is added to the width of the pad to allow for overhang and stitching to pads 1 and 2. The typical length being around 5.0-8.0 inches. The most typical length of the pad 3 is around 6 inches. The length side of the pad 3 is stitched at 5 to the topside of pads 1 and 2.

Due to the "saddle" design and style, the device can be applied to the instrument with or without the use of the suction cups 4A. The suction cups 4A in one embodiment have a 1.168 inch cup and a typical mushroom head design with a 0.25 inch diameter neck, and they are attached to pad 3 by means of a punched 0.25 inch hole with an adjacent 0.25 inch slit to provide ease of attachment to the guitar. A typical range for suction cup sizes are 0.8-1.74 inches. As illustrated in FIG. 8 the position of these holes with slits are 1.0 inch in from the front at centerline of width of pad 3 and 1.0 inch in from the back at centerline of width of pad 3. The slits extend 0.25 inch from each hole toward the opposing hole.

Figure 6:
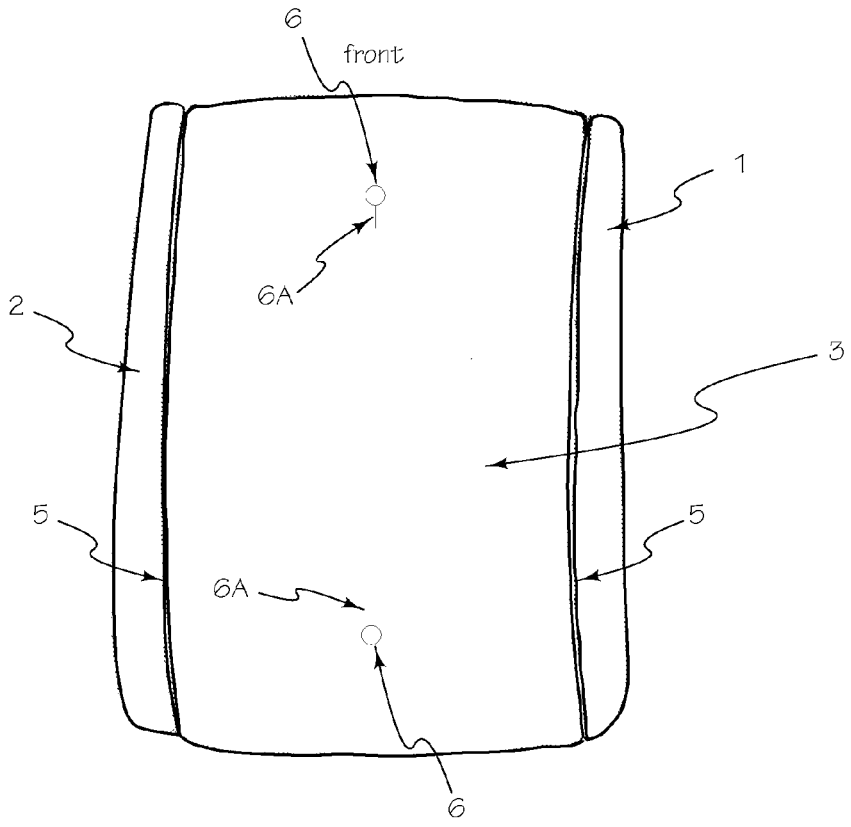
FIG. 6 is a top plan view displaying the holes 6 and position of adjacent slits 6A. It represents an embodiment without suction cups.

FIG. 6 and FIG. 8 represent an embodiment without suction cups.

It is an objective of the disclosed subject matter to provide a saddle design shaped protective pad or cover device comprised of leather (or leather like material with properties such as comfort, pliability, sewabilty, durability, high tensile strength, resistance to tear, and high resistance to flexing-flexibility). The saddle design shaped protective pad or cover device is positioned on existing portions of a musical instrument body, where the device covers and contacts the top and front surface on the lower bout of the instrument body to protect it and the arm of the performer where an arm of the performer of the said musical instrument meets the instrument in a performing position.

It is yet another objective of the disclosed subject matter to provide a device with a sown in saddle design shape wherein the front side of the device is lifted off the musical instrument body or guitar so as not to mute the vibrations and lessen the response of the soundboard.

It is yet another objective of the disclosed subject matter to provide a device with attachment means on the bottom of the pad to secure it to a guitar such as a suction cup or cups where said device with the suction cup or cups contacts and is secured to the top side of the lower bout of the guitar.

I claim:

1. A leather or leather like protective pad or device with leather like physical attributes, which include comfort, pliability, sewabilty, durability, high tensile strength, resistance to tear, and high resistance to flexing or flexibility positioned on existing portions of an acoustical musical instrument body, where said device is in contact with a top and front surface on a lower bout of the instrument body to protect both the instrument and an arm of a performer where an arm of the performer of the musical instrument meets the instrument in a performing position, with the protective pad or device having a sown in saddle design shape wherein a front side of the device is lifted off the musical instrument so as not to mute the vibrations and lessen the response of a soundboard.

2. A saddle design shaped protective pad or cover device in claim 1 comprised of sewable and pliable faux leather, vinyl, neoprene, or a polymer with leather like attributes.

3. A device as in claim 1 where the musical instrument is an acoustic or a classical guitar.

4. A device as in claim 1 where a saddle design shaped protective pad or cover device keeps sweat off of the soundboard of the musical instrument and the arm of the performer.

5. A device as in claim 1 where a saddle design allows for a secure attachment to the instrument.

6. A device as in claim 1 with optional attachment means on a bottom of a saddle design shaped protective pad to secure it to a guitar.

7. A device as in claim 1 with attachment means as a suction cup or cups where said device with a suction cup or cups contacts and is secured to a top side of a lower bout of the guitar.

8. A device as in claim 1 with an option of padding between the device and the topside of the lower bout of the guitar.

9. A device as in claim 1 where the acoustical musical instrument is selected from a group consisting of a banjo, a mandolin, a sitar, and a balalaika.

10. A saddle design shaped protective pad or cover device in claim 1 comprised of leather.

11. A method to produce a leather or leather like protective pad or device with leather like physical attributes, which include pliability, sewabilty, durability, high tensile strength, resistance to tear, and high resistance to flexing or flexibility positioned on existing portions of an acoustical musical instrument body where said device is in contact with a top and front surface on a lower bout of the instrument body to protect both the instrument and an arm of a performer where an arm of the performer of the musical instrument meets the instrument in a performing position, with the protective pad or device having a sown in saddle design shape wherein a front side of the device is lifted off the musical instrument so as not to mute the vibrations and lessen the response of a soundboard.

* * * * *